US011913743B2

(12) United States Patent
Balhan et al.

(10) Patent No.: US 11,913,743 B2
(45) Date of Patent: Feb. 27, 2024

(54) PISTOL FIRING DEVICE

(71) Applicant: FN HERSTAL S.A., Herstal (BE)

(72) Inventors: Laurent Balhan, Mormont (BE); Dorian Delvaux, Oupeye (BE)

(73) Assignee: FN HERSTAL S.A., Herstal (BE)

( * ) Notice: Subject to any disclaimer, the term of this patent is extended or adjusted under 35 U.S.C. 154(b) by 0 days.

(21) Appl. No.: 17/996,918

(22) PCT Filed: Apr. 21, 2021

(86) PCT No.: PCT/EP2021/060339
§ 371 (c)(1),
(2) Date: Oct. 21, 2022

(87) PCT Pub. No.: WO2021/214118
PCT Pub. Date: Oct. 28, 2021

(65) Prior Publication Data

US 2023/0175799 A1 Jun. 8, 2023

(30) Foreign Application Priority Data

Apr. 23, 2020 (EP) ..... 20171208

(51) Int. Cl.
*F41A 19/29* (2006.01)

(52) U.S. Cl.
CPC ..... *F41A 19/29* (2013.01)

(58) Field of Classification Search
CPC ..... F41A 19/29; F41A 19/25; F41A 19/26; F41A 19/27
USPC ..... 42/69.01, 69.02, 69.03
See application file for complete search history.

(56) References Cited

U.S. PATENT DOCUMENTS

| | | | | | |
|---|---|---|---|---|---|
| 2,522,628 | A * | 9/1950 | Maillard | F41A 3/40 | 89/190 |
| 5,081,780 | A * | 1/1992 | Lishness | F41A 19/35 | 267/180 |
| 5,517,896 | A * | 5/1996 | Perrine | F41A 3/50 | 89/189 |
| 2010/0229447 | A1* | 9/2010 | Metzger | F41A 19/48 | 42/69.03 |
| 2012/0167755 | A1 | 7/2012 | Rosol et al. | | |
| 2015/0323274 | A1* | 11/2015 | Toner | F41A 17/56 | 42/70.01 |

(Continued)

FOREIGN PATENT DOCUMENTS

| | | | | |
|---|---|---|---|---|
| DE | 102019000301 B4 * | 12/2022 | ..... | F41A 19/13 |
| WO | 03081160 A1 | 10/2003 | | |

OTHER PUBLICATIONS

International Search Report and Written Opinion of the International Searching Authority from the European Patent Office, in PCT/EP2021/060339 dated Jun. 29, 2021, which is an international application corresponding to this U.S. application.

*Primary Examiner* — John Cooper
(74) *Attorney, Agent, or Firm* — Kolitch Romano Dascenzo Gates LLC

(57) ABSTRACT

A pistol may include a firing device arranged in a slide. The firing device includes a strikerhaving a striker head, characterized in that the device has at least two parallel striker springs arranged laterally on the side of the striker axis and bearing on at least two bearing surfaces arranged perpendicularly to the axis of the striker.

17 Claims, 2 Drawing Sheets

(56) References Cited

U.S. PATENT DOCUMENTS

| | | | | |
|---|---|---|---|---|
| 2016/0102938 | A1* | 4/2016 | Sroufe | F41C 3/00<br>42/16 |
| 2018/0112944 | A1* | 4/2018 | Underwood | F41A 17/56 |

* cited by examiner

PISTOL FIRING DEVICE

TECHNICAL FIELD

The present disclosure relates to a pistol percussion device.

INTRODUCTION

In general, pistol firing devices comprise either a hammer producing a shock at the rear of a striker, the front end of which strikes the primer of a chambered munition, or a pre-armed striker set in motion by a compressed spring when the gun is loaded.

The current trend is to abandon hammer devices. Indeed, such open devices easily become clogged, or can become blocked due to an object placed between the hammer and the striker.

In the case of pre-armed strikers, the spring must be able to store enough energy so as to provide a safe percussion, while occupying a small space, in particular compared to the longitudinal axis of the pistol. For a balanced movement of the striker, the percussion spring is generally arranged concentrically about the axis of the striker, either around the striker or inside the striker. The striker then serves as a guide for the spring so as to reduce the risk of buckling during compression.

Such concentric arrangement greatly limits the choice of the spring and forces a compromise between either a short spring subject to high cyclic stresses potentially causing fatigue ruptures, or a longer spring inducing an elongation of the slide.

The reliability of the firing device is directly related to the amount of energy stored in the striker spring, and given the above-mentioned constraints it is difficult to increase such amount in prior art devices without increasing the bulk of the device.

SUMMARY

The present disclosure relates to a pistol comprising a firing device arranged in a slide, said device comprising a striker comprising a striker head and at least two striker springs arranged laterally on the side of the striker axis and bearing onto at least two lateral bearing surfaces arranged perpendicular to the striker axis.

"Lateral" means that the axes of the springs are parallel and arranged both either above or below, and either to the left or to the right.

Preferably, the at least two springs and the corresponding bearing surfaces are arranged symmetrically about the striker axis.

In the present description, "symmetrical" refers to any type of symmetry, including rotation symmetries, so that the torques applied by the at least two springs cancel each other out: there can be two springs arranged symmetrically on either side of the axis or a rotational symmetry of order 3 (three springs located on a circle at angles separated by) 120°.

According to preferred embodiments of the present disclosure, the slide comprises one or a suitable combination of at least two of the following features:

the striker comprises at least two recesses arranged around the axis thereof for receiving said at least two springs;

the device comprises only two striker springs arranged symmetrically on either side of the striker axis, the two springs being arranged on both sides of the striker axis;

said striker springs and said striker are arranged in a slide housing, said housing comprising a stop surface for the striker springs, for stopping the spring pressure on the striker bearing surfaces before the striker head emerges from a receiving bottom of the slide, so as to allow the striker to follow a free path at the end of the percussion movement and to return to the rear rest position of the striker at rest without emerging from the receiving bottom;

a return spring bearing on the slide and applying a rearward force to the striker is arranged in said housing of the slide;

the weight of the striker is comprised between 1.5 and 6 g, preferably between 2 and 3 g;

the housing is provided in a housing fastened to the slide;

the housing is made of polymer;

said striker and said at least two springs are pre-assembled in said housing, said springs being held in position by a spring support comprising at least two spring guides inserted inside said springs;

the slide is essentially metallic and the striker comprises a rod for supporting the striker head sliding in a guide conduit (preferably cylindrical) of the striker provided in the metal of the slide;

said at least two springs, the axes of which are parallel to each other, are compression springs;

the respective axes of said at least two springs and the axis of the striker are coplanar.

LEGEND OF THE FIGURES

Figure 1:
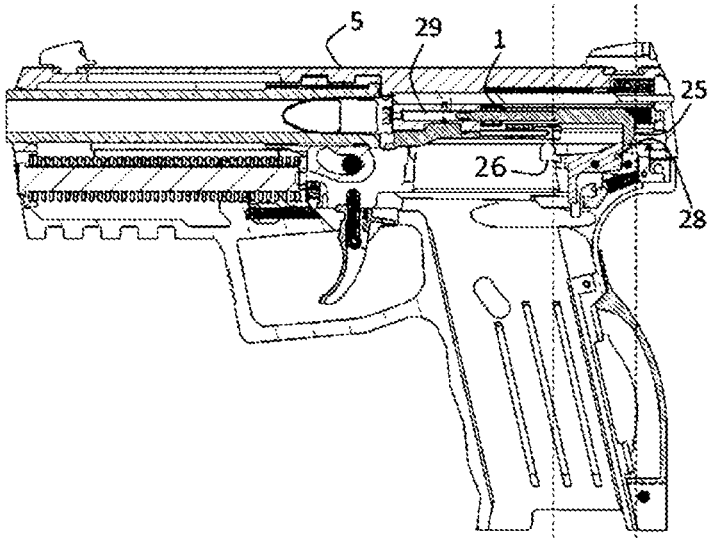
FIG. 1 shows a cross-section of an example of a pistol according to the present disclosure.
Figure 2:
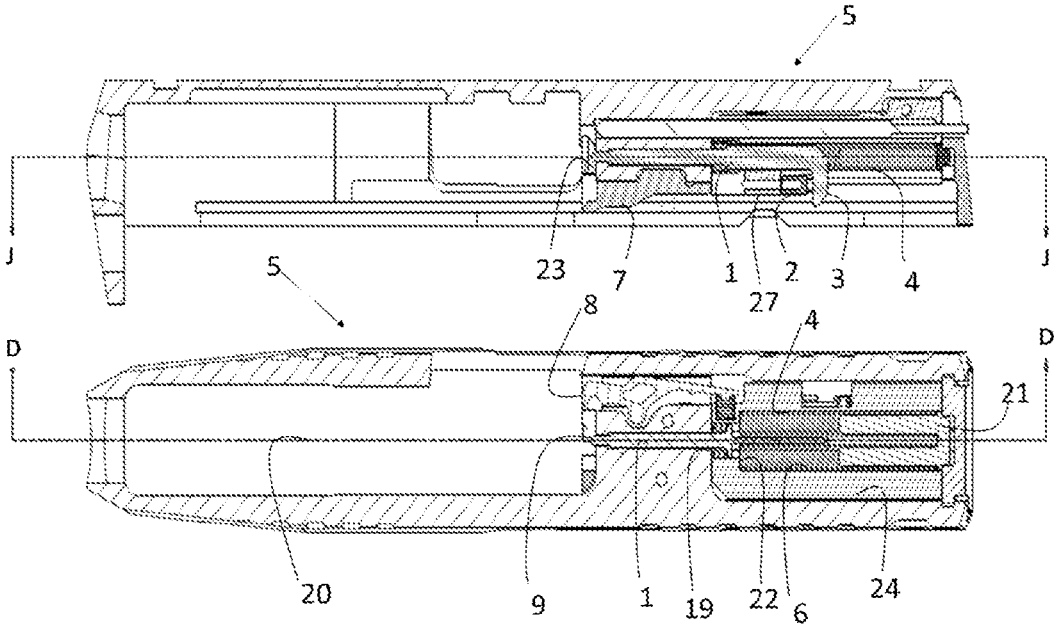
FIG. 2 shows a cross-section, in a top view and in a side view, of a slide of a pistol according to the present disclosure.
Figure 3:
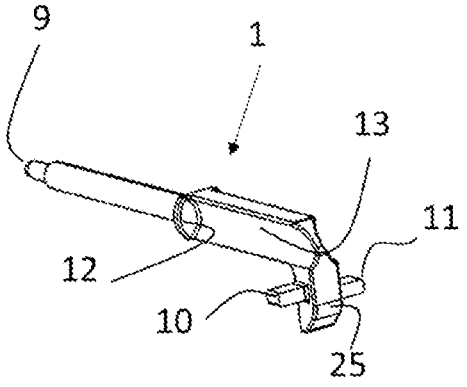
FIG. 3 shows a perspective view of a pistol striker according to the present disclosure.
Figure 4:
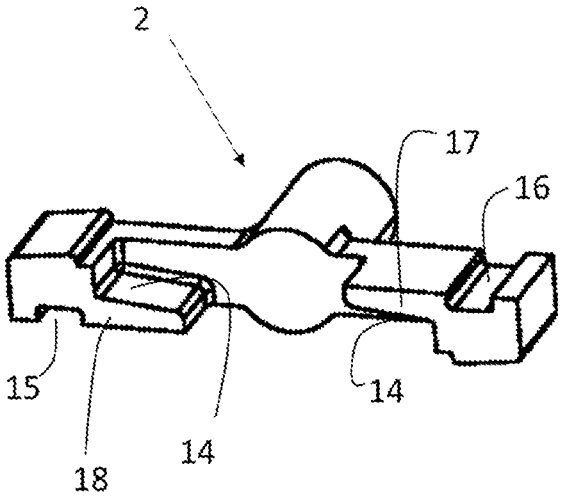
FIG. 4 represents a perspective view of a safety catch for the blocking the striker.

1. striker
2. striker lock (safety catch)
3. striker stop
4. right-hand striker spring
5. slide
6. left-hand striker spring
7. slide insert
8. extractor claw
9. striker head
10. left-hand striker safety pin
11. right-hand striker safety pin
12. spring bearing surface
13. striker spring housing recess
14. striker safety pin housing recess
15. Equivalent recess to the return spring housing in order to balance the catch
16. Return spring housing
17. Bearing surface of the right-hand striker safety pin
18. Bearing surface of the left-hand striker safety pin
19. Striker return spring
20. Striker axis

21. Spring support
22. Spring stop surface 4,6
23. Receiving bottom (or breechblock bottom or percussion bottom)
24. Casing
25. Lateral extension of the striker
26. Striker safety control trigger
27. Rotation axis of the safety catch
28. Striker trigger
29. Striker guide channel

DETAILED DESCRIPTION

The present description essentially describes an example of a gun implementing all of the aspects of the present disclosure. A person skilled in the art will easily understand that the different aspects of the present disclosure, although usable separately, have synergies which will become clearly apparent given the example and the few variants described.

The present disclosure relates to a pistol comprising a firing device wherein the percussion energy is supplied by at least two striker springs 4,6 arranged symmetrically on both sides of the striker axis 20, unlike the prior art where a single spring arranged concentrically about the axis is used.

Indeed, the use of two springs makes it possible to reduce the length of each of the springs for a given energy and stress level. It is in this way possible to store sufficient energy in the springs while providing a long service life given the level of acceptable stresses in the springs, in particular with regard to the fatigue of the springs. However, the higher the energy, the more the percussion is provided, especially in adverse conditions.

The use of a plurality of springs with suitable length and working in parallel makes it possible to use a lower stiffness for providing the same level of energy. The goal thereof is also to reduce the energy required for the "racking" of the gun (manual rearming). Since the stiffness of the percussion springs is lower, it is therefore possible to reduce the force of the recuperator spring dimensioned so as to set the slide in firing position and tension the percussion springs. The present disclosure thus can be further used for improving the general comfort in using the gun and the service life thereof.

Advantageously, the placement of the springs next to the striker makes it possible to make the striker tapered and lighter. However, the lighter the striker, the more reliable the firing of the primer for the same potential energy stored in the percussion spring(s). Preferably, the weight of the striker is comprised between 1.5 and 6 g, preferably between 2 and 3 g.

According to a preferred embodiment, the striker comprises at least two symmetrical recesses 13 on both sides of the striker axis 20, so as to receive the at least two springs 4,6. Such recesses reduce the total weight of the striker and reduce the torque generated by each spring by moving the spring closer to the striker axis.

According to the prior art, the thrust of the spring is exerted only over a part of the striker stroke. The end of the striker stroke then takes place without any contact with the spring. Thus, a small return spring makes it possible to push the striker out of the receiving bottom. The vertical displacement of the cartridge during unlocking can then take place without rubbing on the striker and hence without any risk of breaking the striker. In the prior art, the free stroke of the striker is generally achieved by adding components, which leads to an increased complexity and an increase in the price of the gun.

According to a preferred embodiment of the present disclosure, after an initial stroke pushed by the springs, the percussion springs 4,6 no longer press on the striker but against a stop surface 22 of a housing in the slide 5 receiving the firing device according to the present disclosure. The striker thus travels freely from such point. It should also be noted that the use of a light striker makes possible the use of a very weak striker return spring and thus having little impact on the percussion energy stored in the system, the return spring being put in opposition to the percussion springs.

In general, the slide is the most expensive component of the pistol. A significant reduction in the price thereof can be achieved by using a plastic casing which eliminates costly machining operations in the slide.

Advantageously, said housing is provided in a casing 24 fastened to the slide 5. Preferably, said casing 24 is made of polymer while the rest of the slide is essentially metallic.

Advantageously, said striker 1 and said at least two springs 4,6 are pre-assembled in said casing 24, said springs being held in position by a spring support 21 comprising at least two spring guides inserted inside said springs 4,6.

In the case of a polymeric casing, guiding the striker so as to remain concentric with the primer can be an additional technical difficulty.

In order to solve such problem, the striker 1 is preferably guided throughout the stroke thereof in a channel 29 provided in the metal part of the slide 5 opening out into the receiving bottom 23. Guiding then takes place via a support shaft or rod for the striker head 9 in a bore opening out into the receiving bottom 23. Preferably, the slide is essentially metallic and the striker 1 comprises a support rod for the striker head 9 sliding in a cylindrical guide conduit for the striker 1 provided in the metal of the slide 5.

According to preferred embodiments of the present disclosure compatible with the above-described modes, the pistol further comprises a striker safety device integrated into the slide 5, the striker 1 comprising a lateral extension 25 comprising two safety pins 10,11 and a striker safety catch 2 arranged on a rotation axis 27 fastened to the slide and parallel to the striker translation axis 20, the safety catch 2 being apt to rotate in a vertical plane between a firing position and a blocking position, said catch 25 comprising two bearing surfaces 17,18 on which said pins 10,11 rest when said catch is in the blocking position and two recesses 14 which can let through said pins 10,11 when said catch is in the firing position, the center of mass of said catch 2 being on the rotation axis 27 thereof and the rotation axis 27 being a main axis of inertia of said catch 2.

The catch 2 is actuated in rotation by a safety control trigger 30, which is as such actuated by the fire control chain controlled by a trigger blade.

The invention claimed is:

1. A pistol comprising:

a firing device arranged in a slide, said firing device comprising a striker comprising a striker head, wherein the firing device comprises at least two striker springs arranged adjacent and parallel to an axis of the striker; and wherein each of the at least two striker springs are configured to bear on a rearward side of a corresponding bearing surface extending from the striker, each of the corresponding bearing surfaces arranged perpendicularly to the axis of the striker, such that the at least two striker springs collectively apply a force to urge the striker forward.

2. The pistol according to claim 1, wherein the at least two striker springs and the corresponding at least two bearing surfaces are arranged symmetrically about the striker axis.

3. A pistol according to claim 1, wherein the striker further comprises at least two recesses arranged about the striker axis and configured to receive said at least two striker springs.

4. The pistol according to claim 1, wherein the at least two striker springs are exactly two striker springs arranged on opposing sides of the striker axis.

5. The pistol according to claim 1, wherein said at least two striker springs and said striker are arranged in a housing of the slide, wherein said housing comprises a stop surface configured to arrest the at least two striker springs without arresting forward movement of the striker.

6. The pistol according to claim 5, wherein at least one return spring is arranged in said housing of the slide, wherein the at least one return spring is configured to apply a rearward force to the striker.

7. The pistol according to claim 5, wherein said housing is provided in a casing fastened to the slide.

8. The pistol according to claim 7, wherein said housing is made of a polymer.

9. The pistol according to claim 7, wherein said striker and said at least two striker springs are pre-assembled in said casing, said springs being held in position by a spring support comprising at least two spring guides inserted into said springs.

10. The pistol according to claim 1, wherein a mass of the striker is comprised between 1.5 and 6 g.

11. The pistol according to claim 10, wherein the mass of the striker is comprised between 2 and 3 g.

12. The pistol according to claim 1, wherein the slide comprises a metal, wherein the striker comprises a support rod for the striker head, and wherein the support rod is slidably received by a striker guide conduit provided in the metal of the slide.

13. The pistol according to claim 1, wherein respective axes of the at least two striker springs are parallel to one another, and wherein the at least two striker springs are compression springs.

14. The pistol according to claim 13, wherein the respective axes of said at least two striker springs and the axis of the striker are coplanar.

15. A pistol comprising:

a striker arranged in a slide; and two striker springs disposed adjacent and parallel to a long axis of the striker, each of the striker springs configured to bear on a respective protrusion of the striker to bias the striker in a forward direction;

wherein a housing of the slide includes a pair of shoulders configured to arrest the two striker springs independent of the striker during forward motion of the striker.

16. The pistol of claim 15, wherein each of the two striker springs is configured to bear on a rearward side of the respective protrusion.

17. The pistol of claim 15, further comprising a single return spring disposed forward of the two striker springs and coaxial with the striker, wherein the return spring is configured to bias the striker in a rearward direction during operation.

* * * * *